United States Patent [19]

Groveman et al.

[11] Patent Number: 5,005,833

[45] Date of Patent: Apr. 9, 1991

[54] TENNIS TRAINING AID

[76] Inventors: Joseph E. Groveman; Grant D. Groveman, both of 500 E. Amado, Palm Springs, Calif. 92262

[21] Appl. No.: 428,911

[22] Filed: Oct. 30, 1989

[51] Int. Cl.[5] ..... A63B 69/38

[52] U.S. Cl. ..... 273/29 A; 273/183 B; 273/189 R; 273/DIG. 30

[58] Field of Search ..... 273/183 B, 189 R, 191 B, 273/DIG. 30, 29 A, 191 R, 54 B, 73 R, 58 C

[56] References Cited

U.S. PATENT DOCUMENTS

| | | | |
|---|---|---|---|
| 1,655,092 | 1/1928 | Davis | 273/189 R |
| 1,699,219 | 1/1929 | Bemish et al. | 273/189 R |
| 1,728,679 | 9/1929 | Hansard | 273/189 R |
| 3,324,851 | 6/1967 | Posner | 273/189 R |
| 3,606,343 | 9/1971 | Lemon | 273/189 R |

FOREIGN PATENT DOCUMENTS

| | | | |
|---|---|---|---|
| 20463 | of 1907 | United Kingdom | 273/189 R |

OTHER PUBLICATIONS

Golf Digest, p. 68, 11/1974.

*Primary Examiner*—Theatrice Brown
*Attorney, Agent, or Firm*—Edward A. Sokolski

[57] ABSTRACT

A wrist band is provided for each of the user's wrists, such wrist bands being removably attachable to the wrists by wrapping therearound and securing in place by a fastening device such as a Velcro fastener. Each band has a looped thong extended therefrom in the direction of the user's fingers, the user's middle finger fitting through the thong such that palmar flexion of the hand is restricted. The wrist bands are joined together by a strap which is attached to the bands in the region of the user's thumbs. The user's wrists are thus joined together so that in preparing for and in making a tennis stroke, the arms move together so as to facilitate the training of a player to turn the shoulders and twist the body. A single one of the wrist bands can also be used on the hand used for making the toss in serving to train the player to toss the ball straight up or on the racquet holding hand to train the player to avoid palmar flexion while driving the ball.

6 Claims, 2 Drawing Sheets

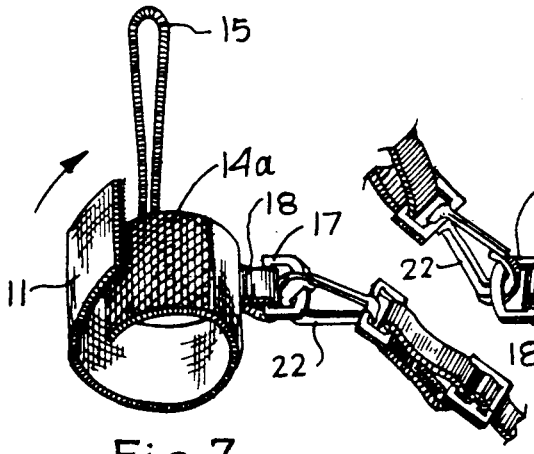
Fig. 7
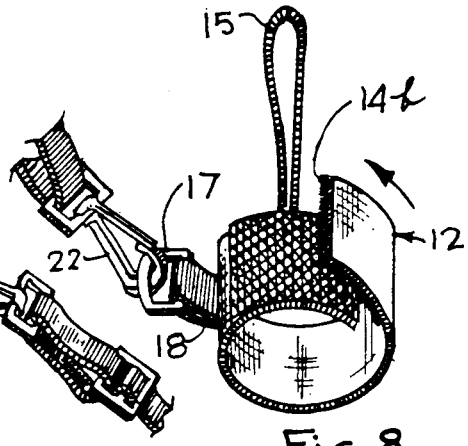
Fig. 8
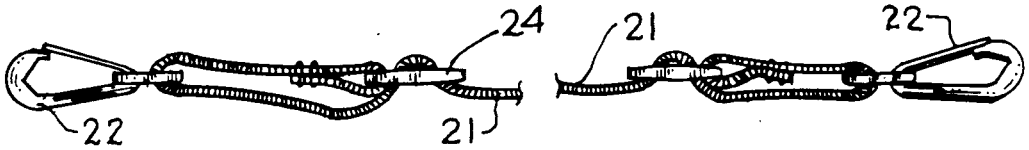
Fig. 9
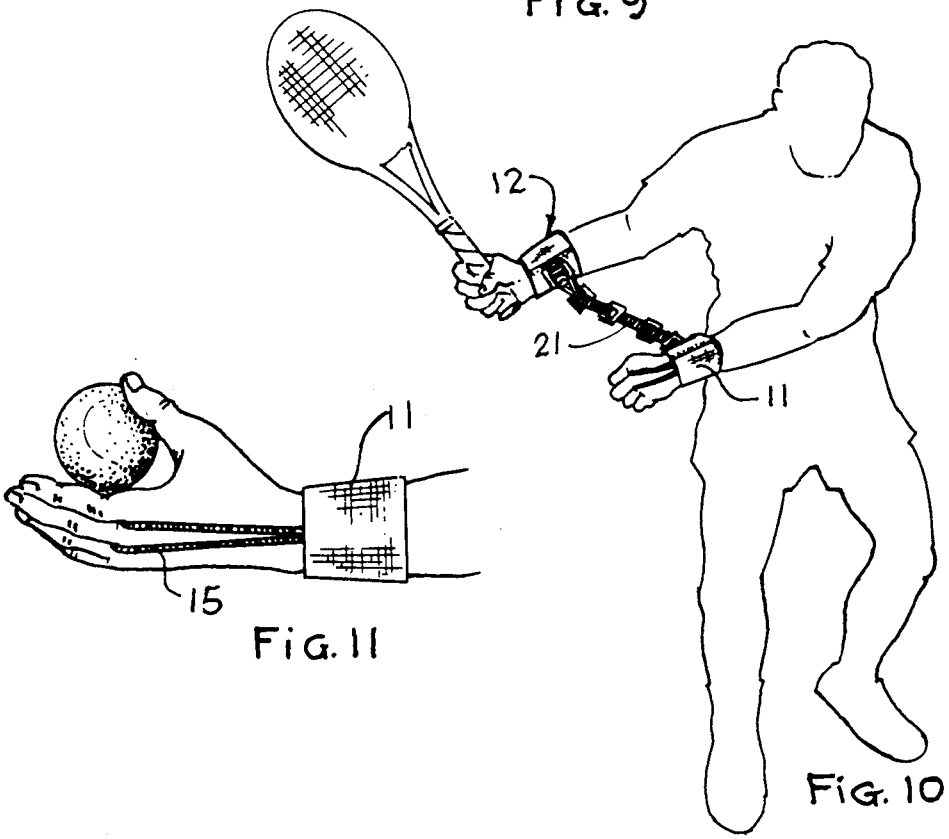
Fig. 11
Fig. 10

TENNIS TRAINING AID

BACKGROUND OF THE INVENTION

1. Field of the Invention

This invention relates to sports training aids and more particularly to such a device which can be used in training a tennis player to properly stroke and serve a tennis ball.

2. Description of the Related Art

It is well accepted that to properly hit a tennis ball the player must turn the shoulders and twist the body preparatory to and while executing the tennis stroke. It is also accepted that during the stroke, the wrist should be kept rigid with the drive being accomplished with the arm and shoulders. For proper serving, a straight toss of the ball is also important.

Not only are these factors important for executing a good stroke and a good serve, but failure to so perform can result in painful injuries such as "tennis elbow" (generally caused by wrist or palmar flexion when hitting the ball); rotator cuff strain or tear (generally caused by over-extension of the arm in follow through); and back strain(often caused by improper toss in serving with rapid forced arching of the back in executing the serve).

Tennis training aids which employ wrist or arm bands which are connected by means of a strap to the tennis racquet are described in U.S. Pats. No. 3,858,881 issued Jan. 7, 1975 to Hurwitz; No. 4,216,960 issued June 24, 1980 to Roberts; and No. 4,150,821 issued Apr. 24, 1979 to Racz.

U.S. Pat. No. 4,030,732 issued June 21, 1977 to Vincent describes a Harness for the Teaching of Tennis in which the tennis racquet is connected by means of straps to a body harness.

U.S. Pat. No. 4,040,632 issued Aug. 9, 1977 to Pawl describes a wrist band which is attached to the wrist and hand of the user to prevent bending of the wrist in executing tennis or golf strokes.

Various type of training guides for tossing the ball in serving in tennis are described in U.S. Pat. No. 4,141,550 issued Feb. 27, 1979 to Denizman; No. 4,180,262 issued Dec. 25, 1979 to Pericles Gabrielidis; and No. 4,034,981 issued July 12, 1977 to Thomas A. Veneziano.

In none of the above devices is there any suggestion of joining the player's wrists together so as to engender the movement of both arams and shoulders together in executing the stroke. Further, there is no suggestion in such prior art of providing a simple thong device which extends from a wrist band and into which the user's middle finger is placed to prevent palmar or wrist flexure as in applicant's device.

SUMMARY OF THE INVENTION

The device of the invention employs a pair of wrist bands which are preferably of an elastic material and which have attachment means thereon such as Velcro fasteners. The wrist bands are wrapped around the tennis player's wrists and secured in place by means of the fasteners. The wrist bands have looped thongs extending therefrom through which the middle fingers of the user are fitted, the thongs operating in conjunction with the wrist bands to restrain against palmar or wrist flexion of the user. The wrist bands are joined to each other by a removable connecting strap, the length of this strap preferably being adjustable. With the user's wrists thus interconnected, the arms and shoulders follow each other resulting in a twisting motion of the body both in preparing for and executing a tennis stroke. The thongs tend to maintain the wrist rigid avoiding palmar flexion of the hand and wrist action during the stroke. In addition, the wrist band and thong can be used, without the strap attached, on the hand tossing the ball in serving or on the racquet holding hand, the thong preventing palmar flexion of the hand or wrist flexion, thus training the player to make a straight up toss and to avoid palmar flexion while driving the ball.

It is therefore an object of this invention to provide a tennis training device for improving one's tennis stroke and serve.

It is a further object of this invention to simplify the instruction of tennis driving and serving.

Other objects of the invention will become apparent from the following description taken in connection with the accompanying drawings.

DESCRIPTION OF THE DRAWINGS

FIG. 7 is a top front perspective view of the left wrist band of the invention folded over to demonstrate how it is wrapped on one's wrist;

FIG. 8 is a top front perspective view of the right wrist band of the invention folded over to demonstrate how it is wrapped on one's wrist; and FIG. 9 is a side elevational view of the interconnecting strap used in the device of the invention;

FIG. 10 is a front perspective view showing the device of the invention being used by a tennis player; and FIG. 11 is a perspective view illustrating the use of the wrist band of the invention on the ball tossing hand in serving.

DESCRIPTION OF THE INVENTION

Figure 1:
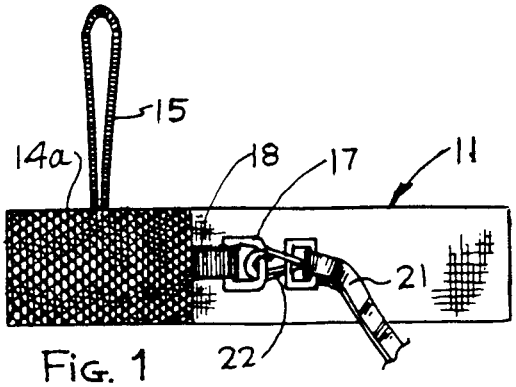
FIG. 1 is a top plan view of a preferred embodiment of the left wrist band of the invention.
Figure 2:
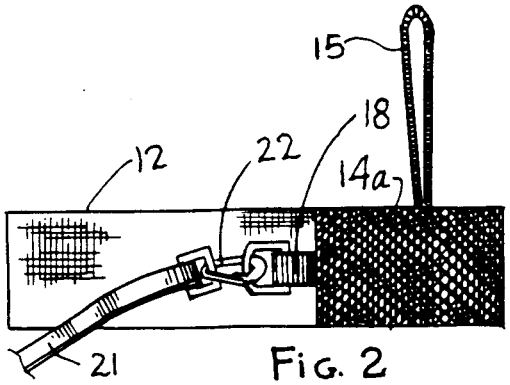
FIG. 2 is a top plan view of a preferred embodiment of the right wrist band of the invention.
Figure 3:
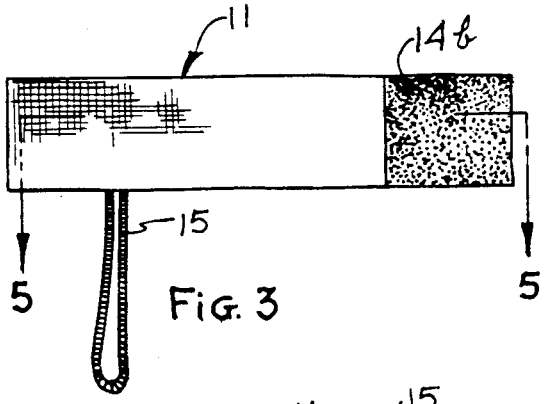
FIG. 3 is a bottom plan view of the wrist band of FIG. 1.
Figure 4:
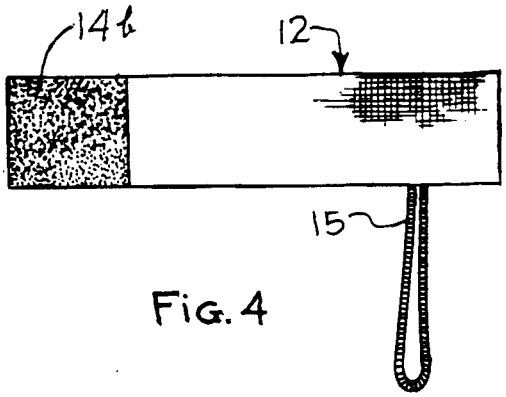
FIG. 4 is a bottom plan view of the wrist band of FIG. 2.
Figure 5:
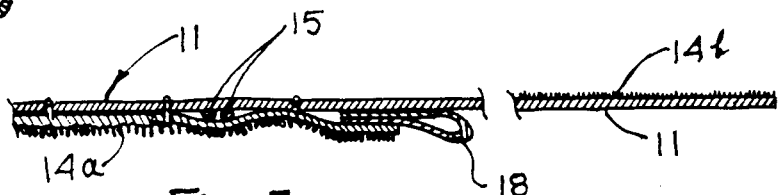
FIG. 5 is a cross sectional view taken along the plane indicated by 5—5 in FIG. 4.

Referring now to FIGS. 1–5, a preferred embodiment of the invention is illustrated. A pair of flat wide wrist bands 11 and 12 are designed for use on the left and right wrists of the user respectively. Bands 11 and 12 are the mirror images of each other and are fabricated of an elastic cloth material such as (give common commercial name of material used). Stitched to one of the ends of each of bands 11 and 12 on one side thereof is one of the mating elements **14*a* of a Velcro fastener while stitched to the opposite end of the other side of each band is the other mating element 14*b* of the fastener. Flexible looped thongs 15 which may be of Nylon cord extend outwardly from each of the bands at an .pa angle substantially normal to the longitudinal axis of the associated band, the thongs being attached to the bands at a location which is approximately at the center of Velcro fastener element 14*a*. A "D" ring 17 is attached to each of the bands by means of a cloth attachment loop 18** which is stitched to the band at a point therealong opposite the inner end of fastener element 14a. The opposite ends of flexible interconnecting strap 21 are removably connected between the "D" rings of bands 11 and 12 by means of clip fasteners 22.

Figure 6:
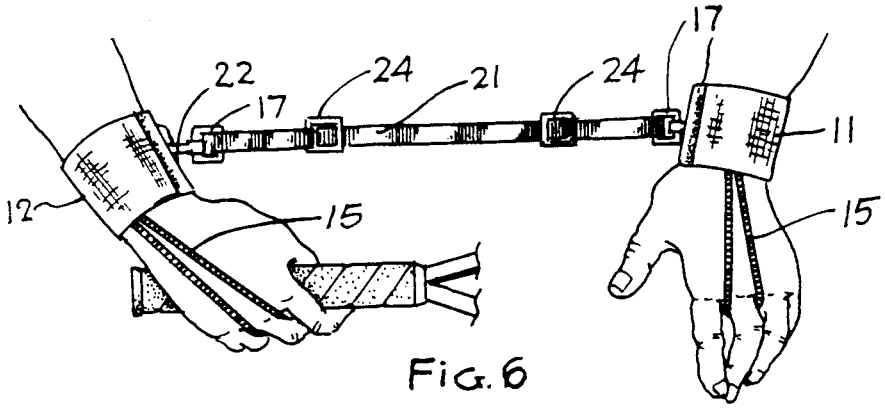
FIG. 6 is a top plan view showing the preferred embodiment installed on the wrists of a tennis player.

Referring now to FIGS. 6,7 and 8, the manner in which the left hand band 11 and the right hand band 12 are attached to the user's wrists is illustrated. As can be seen, in wrapping the bands around the wrists, the "D" rings must be kept in a position directly opposite to where the user's thumbs will lie. The thongs, 15, as can be seen in FIG. 6, are fitted over the user's middle fingers, in effect tethering this finger to the wrist band and thereby restraining the palm of the hand and the wrist against flexion. The length of strap 21 can be adjusted by means of buckles 24, as shown in FIG. 9 to suit users of various sizes and in perfecting various stroking techniques.

Referring now to FIG. 10, the use of the device of the invention in training one to drive a tennis ball is illustrated. As can be seen, as the player moves his right arm back and turns his right shoulder, the right arm and right shoulder are drawn along with it to effect the proper twisting action for preparing for and executing the drive. As already noted, the wrist of the user is restrained against flexing by the thong so that the player is trained to avoid undesirable palmar flexion during the driving of the ball.

Referring to FIG. 11, one of the wrist bands 11 is shown installed on the wrist of the arm used for tossing up the ball in serving(with the connecting strap 21 disconnected therefrom). The wrist band can be used in this manner to train perfection of the toss. This end result is achieved in view of the restraint on palmar flexion of the hand and flexion of the wrist provided by the thong which tends to facilitate a straight up toss. As already noted, one of the wrist bands can also be used on the racquet holding hand to train a player to avoid palmar flexion while driving the ball.

While the invention has been described and illustrated in detail, it is to be clearly understood that this is intended by way of illustration and example only and is not to be taken by way of litation, the scope of the invention being limited only by the terms of the following claims.

We claim:

1. A tennis training aid for attachment to the wrists of a user in training for the driving of a tennis ball comprising:

first and second similar band means, means for securing each of said band means in place when wrapped around a separate one of said wrists, a looped thong means extending from each of said band means for securing one of the fingers of the hand associated with each of said wrists to said band means, thereby restraining said hands against palmar flexion, and strap means for joining said first and second band means together, whereby the arms of a user are caused to move together in preparing for and executing a tennis stroke.

2. The tennis training said of claim 1 wherein said securing means comprises a Velcro fastener attached to opposite sides of said band means at the opposite ends thereof.

3. The tennis training aid of claim 1 wherein said band means comprises a flat wide band of elastic material.

4. The training device of claim 1 wherein said strap means comprises a strap which is adjustable in length, said strap being removably attached to each of said band means in a position thereon which is directly adjacent a users thumb when said band is worn by a user.

5. A tennis training aid for attachment to the wrists of a use in training for the driving of a tennis ball comprising:

a first flat wide band having a looped thong extending therefrom at an angle substantially normal to the longitudinal axis thereof, a second flat wide band and looped thong which is the mirror image of said first band and looped thong, means for firmly securing said first and second bands in place when wrapped around the left and right wrists of a user the user's middle finger of each hand being fitted through one of said looped thongs and thereby being secured to a said band to thereby to restrain the user's hands against palmar flexion, and an adjustably length strap attached at one of its ends to said first band and at the opposite end to said second band, said strap being attached to said bands at a position thereon which is adjacent to where the user's thumbs lie when said band is worn by a user, whereby the user's arms are cause to move together in preparing for and in executing a tennis drive.

6. The tennis training aid of claim 5 wherein said means for securing said bands to the user's wrists comprises Velcro fasteners.

* * * * *